US005857829A

United States Patent [19]

Achelpohl

[11] Patent Number: 5,857,829

[45] Date of Patent: Jan. 12, 1999

[54] DEVICE FOR ISOLATING STACKED FLAT WORKPIECES

[75] Inventor: Fritz Achelpohl, Lienen, Germany

[73] Assignee: Windmöller & Hölscher, Lengerich/Westf., Germany

[21] Appl. No.: 797,953

[22] Filed: Feb. 12, 1997

[30] Foreign Application Priority Data

Feb. 14, 1996 [DE] Germany ..... 196 05 461.3

[51] Int. Cl.[6] ..... B65H 3/06

[52] U.S. Cl. ..... 414/797.3; 414/796.7; 414/797; 198/471.1

[58] Field of Search ..... 198/803.5, 471.1, 198/476.1; 414/796.7, 797, 797.3, 737

[56] References Cited

U.S. PATENT DOCUMENTS

| | | | |
|---|---|---|---|
| 1,887,211 | 11/1932 | Mortimer | 198/476.1 |
| 2,427,712 | 9/1947 | Casler et al. | 198/471.1 |
| 3,303,926 | 2/1967 | Pohl | 198/471.1 |
| 4,050,574 | 9/1977 | Chenevard et al. | 414/737 |
| 4,244,250 | 1/1981 | Rudszinat | 198/803.5 |
| 4,874,076 | 10/1989 | Kaplan et al. | 414/737 |
| 4,902,192 | 2/1990 | Ziegler | 198/803.5 |
| 4,921,397 | 5/1990 | Watanabe | 414/796.7 |
| 5,105,931 | 4/1992 | Lashyro | 198/471.1 |
| 5,234,314 | 8/1993 | Ganz | 414/797 |

FOREIGN PATENT DOCUMENTS

| | | |
|---|---|---|
| 390 443 | 2/1924 | Germany . |
| 1 277 655 | 11/1971 | Germany . |
| 3637182A1 | 5/1988 | Germany . |
| 9 005 225 | 9/1990 | Germany . |

*Primary Examiner*—Karen M. Young
*Assistant Examiner*—Douglas Hess
*Attorney, Agent, or Firm*—Evenson, McKeown, Edwards & Lenahan, PLLC

[57] ABSTRACT

A device for isolating stacked flat workpieces includes a driven, web-like supporting framework which rotates in a frame. Rotating rolls are supported at equal intervals on a circle concentric to the turning axis of the framework. Each roll is provided with a row of suction boxes. Driving gears of the rolls are rotated, in a direction opposite to the rotation direction of the supporting framework, by a spider gear fixed to the framework. Intermediate gears, through which the spider gear rotates the driving gears, are supported in the supporting framework. A stacking cartridge is placed at the external cylinder defined by the row of suction boxes in such a way that each row of suction boxes of each roll withdraws an exposed workpiece from the cartridge. A transport device which removes an isolated workpiece and further transports the workpiece is placed at the external cylinder. In order to prevent a stack from being set into vibration by a passing roll, a stacking cartridge completely confines the stack.

5 Claims, 3 Drawing Sheets

DEVICE FOR ISOLATING STACKED FLAT WORKPIECES

BACKGROUND OF THE INVENTION

1. Field of the Invention

This invention relates to a device for isolating stacked flat workpieces, preferably stacked tubular pieces, including a driven, web-like supporting framework that rotates on a frame. Rotating rolls are supported at equal intervals on a circle concentric with the turning axis of the rolls. Each roll is provided with a row of suction boxes. The driving gears of the rolls are rotated, in a direction opposite to the rotation direction of the supporting framework, by a spider gear fixed to the frame. Intermediate gears, through which the driving gears are rotated, are supported in the supporting framework. A stacking cartridge is placed at an external cylinder defined by the row of suction boxes in such a way that each row of suction boxes of each roll withdraws an exposed workpiece from the cartridge. A transport device placed at the external cylinder removes an isolated workpiece and further transports the same.

2. Description of Related Art

A so-called rotary feeder of this type is known from DE-PS 1,277,655. In the known feeder, a stacking cartridge for accepting a stack of workpieces is located above the external cylinder described by the suction rolls. The stack, which is to be separated into single workpieces, is supported against the suction rolls and against additional back-up rolls arranged between the suction rolls forming the same external cylinder as the suction rolls. This type of support is necessary for the known rotary feeder so that a lower exposed workpiece can be withdrawn from the stack by each suction roll.

However, since suction rolls and back-up rolls supporting a stack impact upon the stack as they pass by, the rolls unavoidably stimulate vibration in the stack. In stack production, rotary feeders are positioned in front of bottom-laying machines. Modern bottom-laying machines have a high capacity so that a rotary feeder must also operate at high speed in order to supply a bottom-laying machine with isolated tubular pieces at a correspondingly increased cadence. However, at higher speeds, a stack supported on the suction and back-up rolls of a rotary feeder tends to start vibrating so forcefully that it is no longer guaranteed that the row of suction boxes of each suction roll will securely pick up the bottom tubular piece in the front edge region of the latter. As a result, either no isolation takes place or a tubular piece to be isolated is only incompletely withdrawn, possibly in an oblique position.

SUMMARY OF THE INVENTION

The purpose of this invention is to create a device of the aforementioned type that ensures that the suction rolls entrain a workpiece to be isolated securely and in the correct position, even at higher isolating speeds.

In accordance with the invention, a stacking cartridge that completely confines a stack to be separated into single workpieces is used.

A complete confinement of this type is to be understood as one in which a stack is no longer supported in a stacking cartridge by suction rolls and intermediate rolls themselves, but is confined in a stacking cartridge without support.

In accordance with a preferred embodiment of the invention, a stacking cartridge is arranged below a supporting framework supporting the suction rolls so that each row of suction boxes takes up the upper exposed workpiece of the stack in order to isolate the same. Since the stack is completely confined in a stacking cartridge, it remains at rest, free from vibration, so that each passing row of suction boxes can pick up the upper exposed workpiece securely and in the correct position.

In principle, it is also possible in accordance with the invention to arrange a stacking cartridge above a rotary feeder. In this way, stacks to be separated into single workpieces can be replenished from above, since each workpiece to be isolated is withdrawn from the stack from below. However, additional confinement devices must be provided for an arrangement of this type. These additional confinement devices support the stack as a whole and release the bottom workpiece with each pass of a suction roll.

It is more expedient for the base (not shown) of a cartridge supporting a stack to be designed such that it can be lifted. As a result, a stack can be raised when the height of the stack decreases due to the isolation of workpieces.

In accordance with an additional preferred embodiment of the invention, a stacking cartridge includes a vertical shaft into which two pairs of grate-shaped prongs project from opposite sides. The prongs of each pair lie on the same horizontal plane and, taking the place of each other, can be raised and lowered and conducted in and out of the shaft. A new stack to be separated into single workpieces is placed on the bottom prongs of a pair of prongs. This stack is then raised until it comes to rest against the upper stack being separated into single workpieces.

After coming to rest against the upper stack, the prongs supporting the upper stack are moved out of the shaft, lowered and moved back into the shaft so that they are ready to accept the next stack.

Advantageously, the guides and drives for the guides carrying the grate-shaped prongs are arranged on the vertical belts of a continuous, driven and reversible traction mechanism.

In accordance with an additional preferred embodiment, vertical sheets aligning the stacks are arranged at the opening of the shaft. At least two opposite sheets are driven so that they are set into vibration. The vibrating sheets align individual workpieces of the stack, straightening their edges, so that the upper workpiece can be picked up in the correct position by a passing suction roll. Since rows of suction boxes of the suction rolls move on cycloids, the passage of the suction rolls can be coordinated with the stacks in such a way that a row of suction boxes picks up the front edge of a workpiece to be isolated approximately at a stationary point at which the workpiece has no speed. This ensures that the single workpieces are separated in a supple and smooth manner.

In accordance with another preferred embodiment, a transport device for removing and further transporting an isolated workpiece has at least one rotating row of suction boxes driven intermittently in such a way that it picks up a workpiece when the workpiece is at an approximate standstill when the row of suction boxes of a suction roll revolving on a cycloid likewise passes through a resting point or a reversal point. In accordance with this configuration, a transport device for further transport removes an isolated workpiece from a rotary feeder when the isolated workpiece is almost at a standstill and takes over further transport.

Advantageously, freely rotating pulleys are supported on the shaft of a row of suction boxes. The pulleys form the guide pulleys of a system of parallel continuous belts of a double belt conveyer which transports away an isolated workpiece. Continuous belts of a second conveyor belt, which are set to clamp onto the first system of continuous belts, cooperate with the continuous belts revolving about the guide pulleys.

BRIEF DESCRIPTION OF THE DRAWINGS

An embodiment of the invention is explained in greater detail in the following with the aid of the drawing figures.

DESCRIPTION OF THE PREFERRED EMBODIMENT

Figure 1:
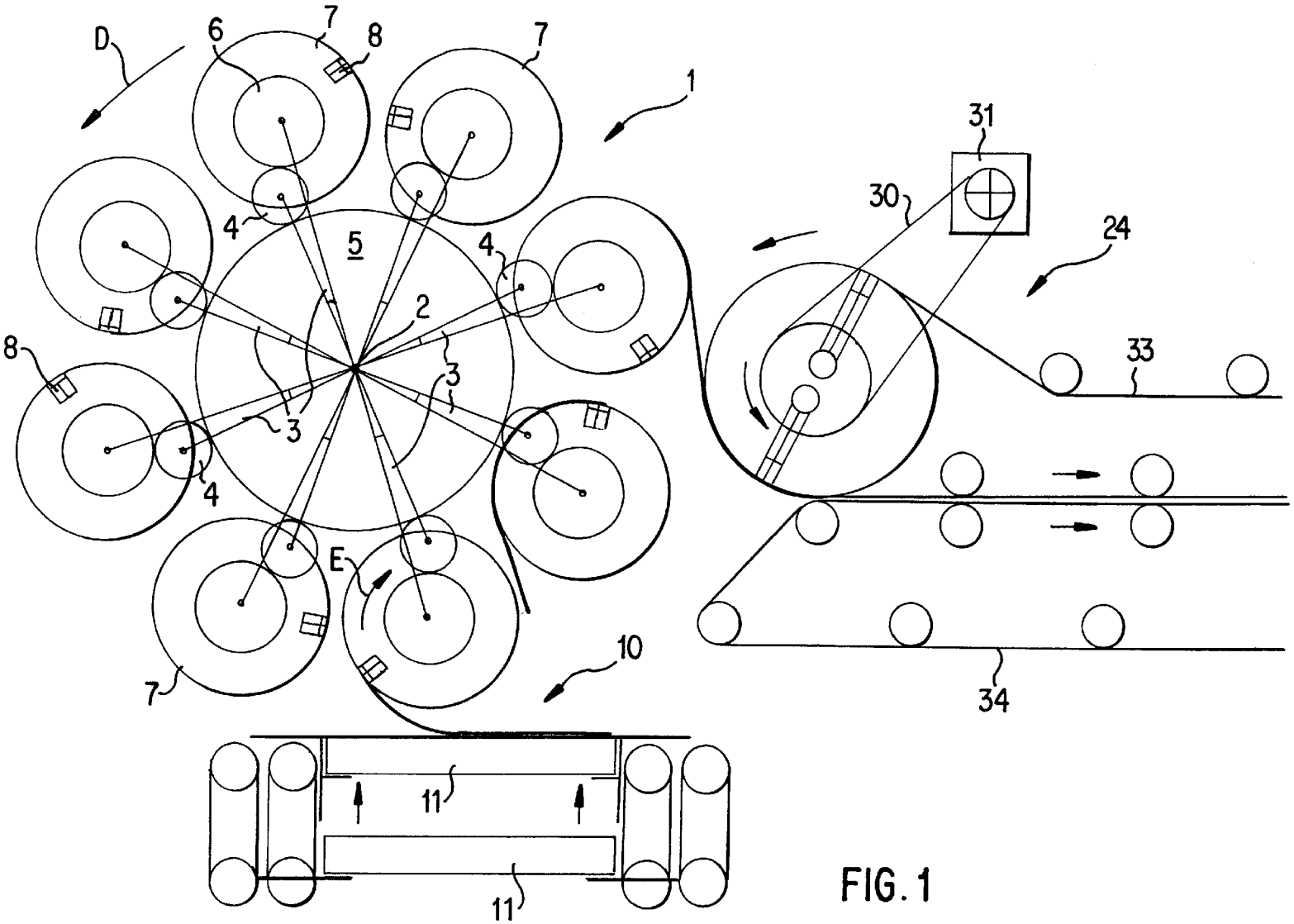
FIG. 1 is a schematic side view of a rotary feeder in accordance with the invention and having a stacking cartridge and a transport device for transporting away an isolated workpiece.
Figure 2:
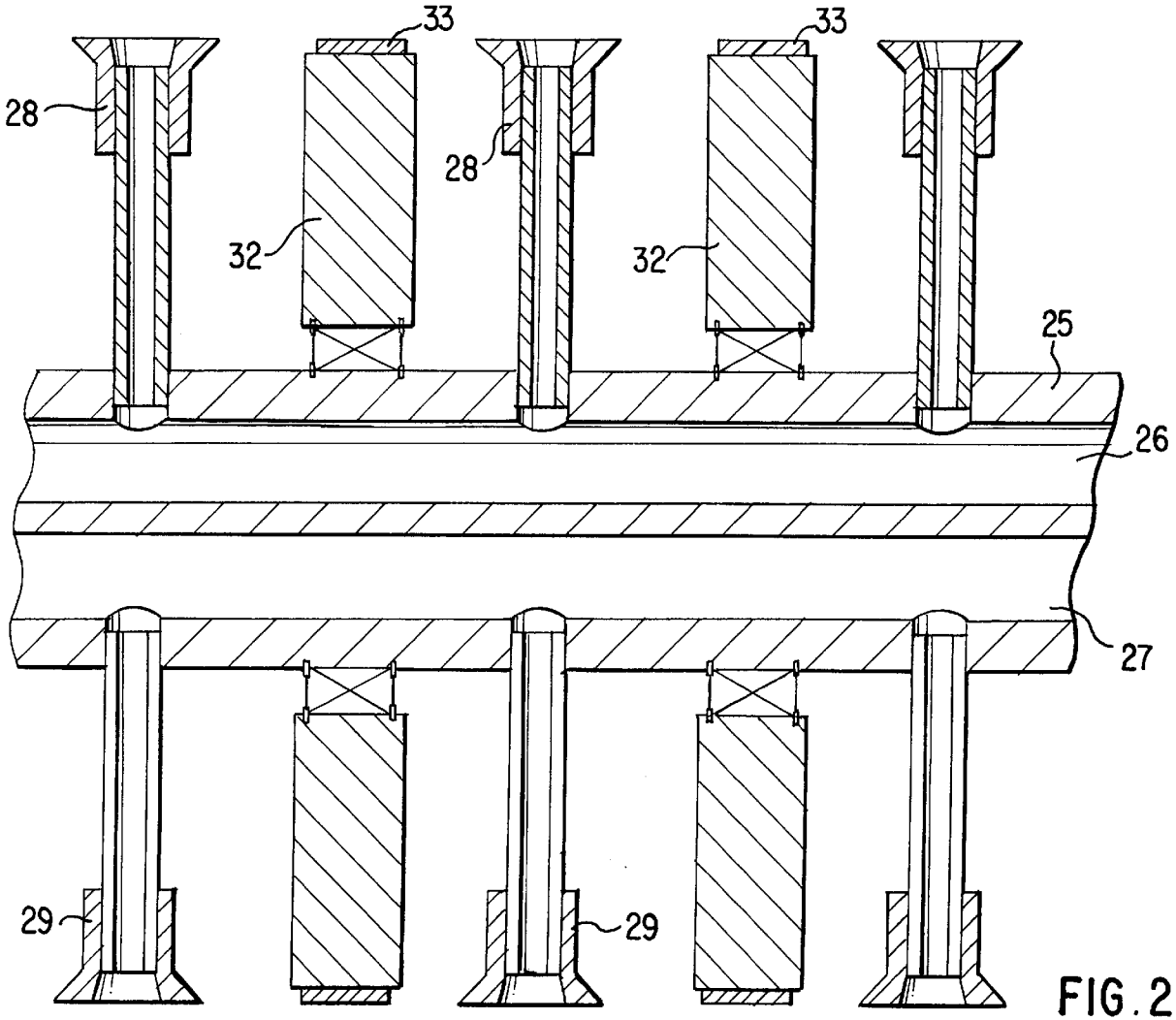
FIG. 2 is a sectional view of the rotating rows of suction boxes which remove an isolated workpiece from a rotary feeder.

In FIG. 1, a rotary feeder (1) includes a carrier star (3) having off-center disks of a web-like supporting framework rotating about an axis (2) on a machine frame, not shown. The carrier star is provided with a rotary drive, not shown. Eight intermediate gears (4), freely rotating on the carrier star (3), engage a spider gear (5) fixed to the frame and toothed gears (6) which engage the shafts of suction rolls (7) freely rotating on the carrier star (3). A row of suction boxes (8) is provided along a surface line of each suction roll (7). In this respect, the rotary feeder corresponds to the rotary feeder known from DE-PS 1,277,655, to which reference is made for further disclosure.

A stacking cartridge (10) for accepting a stack (11) of workpieces to be separated into single workpieces is arranged in the machine frame below the rotary feeder. The stacking cartridge (10) has a stacking shaft. At the sides of the shaft, continuous traction mechanisms are arranged that rotate about guide pulleys and driven rollers. Guides (14, 14' and 15, 15') for grate-shaped prongs (16, 16' and 17, 17'), which can be conducted into and out of the stacking shaft, are supported on belts (12, 12' and 13, 13') of the continuous traction mechanisms facing the stacking shaft. The grate-shaped prongs are provided with driving mechanisms, not shown, by which the prongs can be conducted, in the direction of double arrows A, into and out of the stacking shaft (10). The belts of the continuous transport mechanisms carrying the guides are driven so that they are reversible in the direction of double arrow B. An upper stack (11) can be lifted when the height of the stack decreases as the stack is isolated into single workpieces. A lower stack (11) can be put against the upper stack, and the upper grate-shaped prongs can be conducted downward in order to accept a new stack for feeding.

Figure 3:
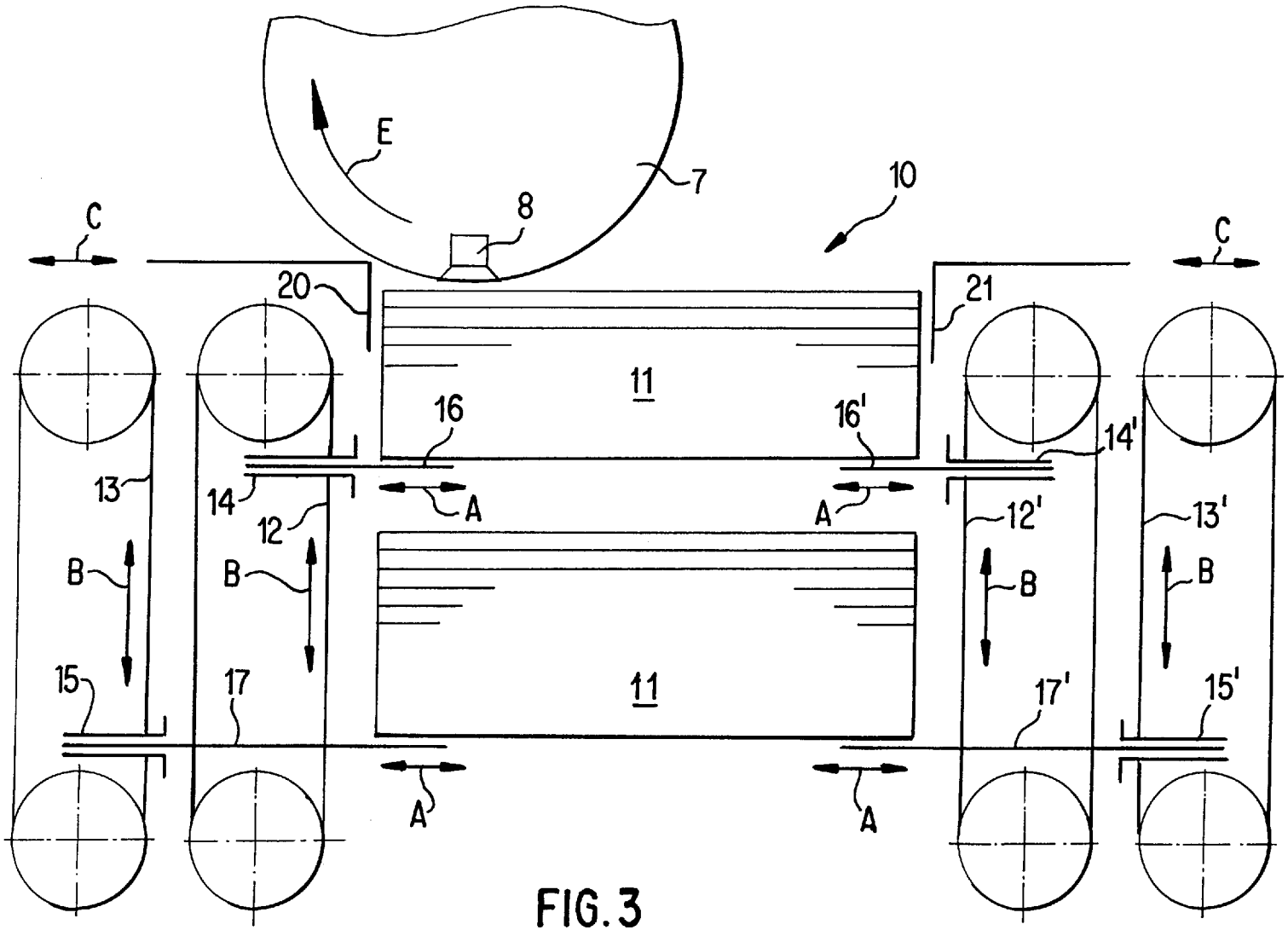
FIG. 3 is an enlarged representation of a stacking cartridge in accordance with FIG. 1.

Lateral vertical sheets (20, 21) are arranged at the upper opening of the shaft (10) and are set into vibration in the direction of double arrow C by vibrating drive mechanisms, not shown, so that the edges of the rising stack (11) are aligned so as to be straight. A carrier star (3) rotates in the direction of arrow D, while individual suction rolls are driven in the direction of arrow E. The geometric relations are matched with each other such that when a row of suction boxes revolving on a cycloid picks up at the reversal point at which it is approximately at a speed of zero, the workpiece to be isolated is in the area of its leading edge, as shown in FIG. 3.

A workpiece isolated by the rotary feeder is turned over by the same to a conveyer (24) for further transport. The conveyor (24) includes a shaft (25) supported in a machine frame, not shown. The shaft (25) is provided with two suction drill holes (26, 27) which are connected to a vacuum source by a rotary transmission leadthrough, not shown. Rows of suction boxes (28, 29), offset from each other by 180°, are placed on the shaft (25). The tubes of the suction boxes (28, 29) carry suction cups and are connected with the suction drill holes (26, 27). A servomotor (31) with controllable speed drives the shaft (25) by a belt (30). Freely rotating pulleys (32) are placed on the shaft (25). Continuous belts (33) of the upper part of a double belt conveyor, which cooperate with the belts (34) of the lower part of the double belt conveyor, run over the pulleys (32).

A servomotor (31) controls the shaft (25) in such a way that a row of suction boxes (28, 29) of a suction roll (7) of the rotary feeder (1) removes an isolated workpiece at an instant in which the row of suction boxes (8) has a speed of approximately zero at the reversal point of the cycloid on which it revolves. In this way, a workpiece can be removed from a suction roll at approximately zero speed, ensuring a smooth delivery.

After removal of a workpiece by a row of suction boxes (28, 29), a servomotor (31) accelerates the shaft (25) from a standstill to the revolving speed of a double conveyor belt. A workpiece, therefore, can be entrained by the double belt conveyor in the correct position and free of acceleration.

I claim:

1. A device for isolating stacked flat workpieces, the device comprising:

a driven supporting framework which rotates in a frame, rotating rolls supported in said framework at equal intervals on a circle concentric with a turning axis of the framework, a row of suction boxes provided on each roll, driving gears for rotating said rolls, a spider gear for rotating the driving gears in directions opposite a rotation direction of the supporting framework, said spider gear being fixed to the frame, intermediate gears supported in the supporting framework through which said spider gear rotates said driving gears, a stacking cartridge placed external to said rotating rolls in such a way that a row of suction boxes of each of said rolls withdraws an exposed workpiece from the stacking cartridge, said stacking cartridge completely confining a stack to be separated into single workpieces, and a transport device, placed external of said rotating rolls, which removes an isolated workpiece and further transports the isolated workpiece, wherein said stacking cartridge includes a vertical shaft, into which two pairs of grate-shaped prongs project from opposite sides, the prongs of each of said two pairs disposed on the same horizontal plane and able to be raised, lowered and conducted in and out of the vertical shaft so as to replace the prongs of the other of said two pairs.

2. The device of claim 1, and further comprising guides and drives for carrying the grate-shaped prongs arranged on vertical belts of said stacking cartridge.

3. The device of claim 1, and further comprising vertical sheets aligning stacks of workpieces arranged at an opening of the shaft, at least two opposite sheets of said vertical sheets being driven in such a way that they vibrate.

4. The device of claim 1, wherein said transport device has at least one other rotating row of suction boxes which is driven intermittently in such a way that it takes up a workpiece approximately when the workpiece is at a standstill when the row of suction boxes provided on each roll passes through a resting or reversal point.

5. The device of claim 1, wherein the stacking cartridge includes a base that can be lifted.

* * * * *